US006092829A

United States Patent [19]

Mercier

[11] Patent Number: 6,092,829

[45] Date of Patent: Jul. 25, 2000

[54] SKI BINDING WITH TWO DISPLACEABLE BINDING ELEMENTS

[75] Inventor: Michel Mercier, Voiron, France

[73] Assignee: Skis Rossignol S.A., Voiron, France

[21] Appl. No.: 09/207,454

[22] Filed: Dec. 8, 1998

[30] Foreign Application Priority Data

Oct. 12, 1997 [FR] France ..... 97 15896

[51] Int. Cl.[7] ..... A63C 9/00

[52] U.S. Cl. ..... 280/617; 280/633

[58] Field of Search ..... 280/616, 617, 280/618, 607, 633, 634, 623, 625, 624

[56] References Cited

U.S. PATENT DOCUMENTS

| | | | |
|---|---|---|---|
| 3,785,666 | 1/1974 | Pierre et al. | 280/633 |
| 3,913,931 | 10/1975 | Kratky | 280/623 |
| 4,135,734 | 1/1979 | Salomon | 280/618 |
| 4,955,633 | 9/1990 | Stritzl et al. | 280/633 |
| 5,190,311 | 3/1993 | Carpenter et al. | 280/618 |
| 5,261,688 | 11/1993 | Rohrmoser | 280/617 |
| 5,344,178 | 9/1994 | Rohrmoser | 280/617 |
| 5,575,496 | 11/1996 | Luitz et al. | 280/618 |
| 5,611,559 | 3/1997 | Luitz et al. | 280/617 |
| 5,947,508 | 9/1999 | Graf et al. | 280/616 |

FOREIGN PATENT DOCUMENTS

| | | |
|---|---|---|
| 2151666 | 4/1973 | France . |
| 4230392 | 4/1993 | Germany . |

OTHER PUBLICATIONS

French search report listing references.

*Primary Examiner*—Richard M. Camby
*Assistant Examiner*—Bridget Avery
*Attorney, Agent, or Firm*—Pitney, Hardin, Kipp & Szuch LLP

[57] ABSTRACT

Ski binding comprising a toe piece and a heel piece slideably mounted on a slide (1) and respectively supporting two connecting arms (2, 3) providing a rack (19, 20) engaging respectively two gears (6, 7); an auxiliary gear means (8, 9) and a gear (7) displaceable, for example, vertically in a manner to be able to occupy two different levels in which it engages with two different gears, the binding elements being displaceable either symmetrically in opposite directions in a manner to enable the adjustment of the binding to the length of the boot without changing the central position of the boot relative to the ski, or in the same direction in a manner to be able to change the central position of the boot relative to the ski.

5 Claims, 4 Drawing Sheets

Fig.1
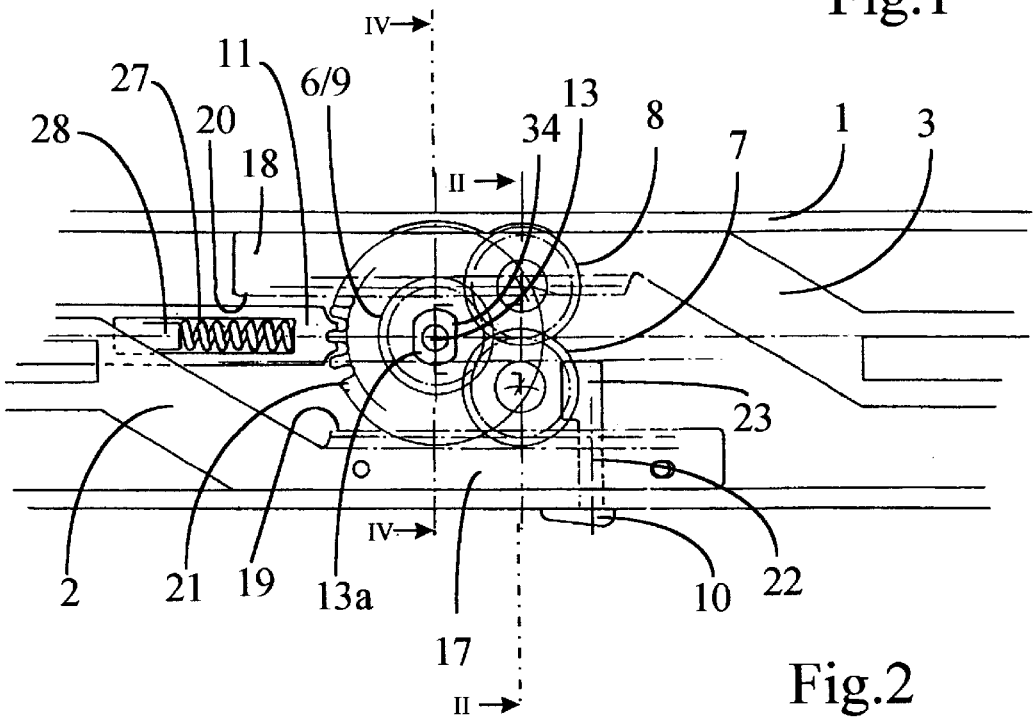
Fig.2
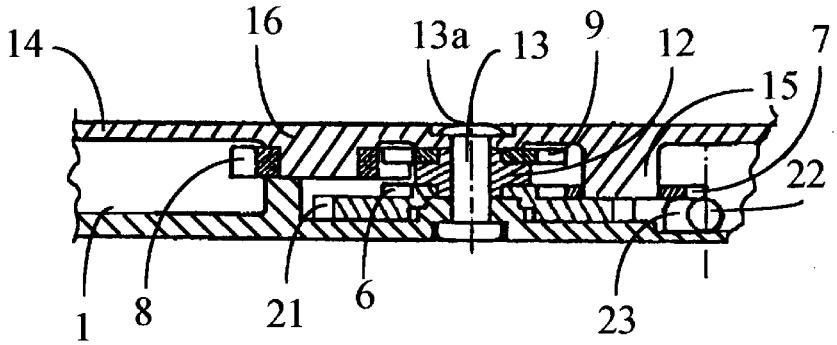
Fig.3
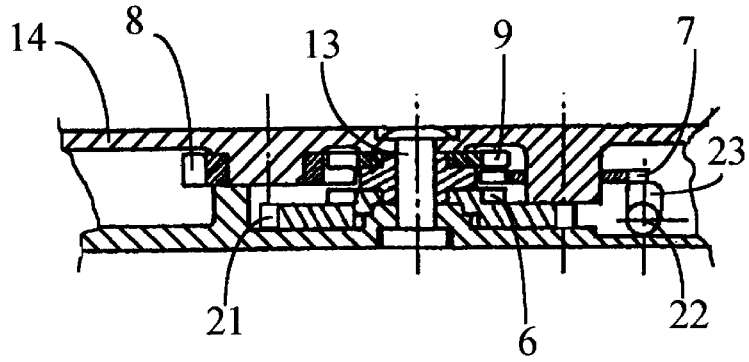
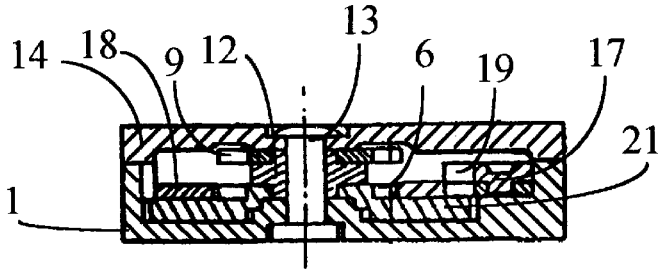
Fig4

SKI BINDING WITH TWO DISPLACEABLE BINDING ELEMENTS

FIELD OF THE INVENTION

The present invention is a binding device for a ski boot comprising a front binding element and a rear binding element displaced longitudinally on a slide fixed to the ski and respectively supported by a connecting bar, the connecting bars being provided with an arm extending parallel to the longitudinal axis of the slide on each side of the axis, in an opposed relationship, and each one presenting a toothed rack for the mutual driving by a gear coupling device mounted between the said arms around an axis perpendicular to the ski and rotatably lockable by a manual locking and unlocking means, the unlocking permitting the simultaneous longitudinal displacement of the binding elements by displacing one of the binding elements.

PRIOR ART

In the prior art, one finds a significant number of ski bindings comprising a mechanism permitting the displacement of the front and rear binding elements for adapting to the size of boots without requiring separation and reattachment to the binding elements in the ski.

According to one type of design, the supports of the binding elements are symmetrically driven in opposite directions by means of a central gear engaging with the two racks respectively supporting the supports of the binding elements. This construction permits the separation or the drawing together of the binding elements with respect to each other, symmetrically relative to a point of the ski corresponding to the axis of the gear. Such designs are described in French patent 2,673,847 and German patent DE 41 35 899.

It has also been proposed to link the mobile binding supports using a parallelogram articulation (FR 2 673 847 and FR 2 344 305) or links driven by a central disk (FR 2 344 305), the central disk being possibly comprised of a wheel having helicoidal teeth driven by a screw (AT 371 349).

In patent DE 41 35 899, a design is described in which the supports of the front and rear binding elements are unlockable and individually displaceable and in which the supports for the binding elements are constituted of two plates presenting superimposed parts and provided with crossing slots through which a stud passes, the transverse displacement of the stud to the ski permitting the displacement of the binding elements symmetrically and in opposite directions.

In patent DE 31 09 754, a ski binding is shown in which the front and rear binding elements are individually displaceable on a support plate. The front binding element comprises a vertical fastening finger coming into engagement in a selected hole of the support plate, while the rear binding element is displaceable by means of a screw cooperating with helicoidal teeth of the support plate.

Finally, in French patent FR 2 339 416, a ski binding is shown having front and rear binding elements which are individually displaceable by means of a slide system.

None of the known designs permit, by means of one and the same coupling device, the selective displacement of the binding elements, and their adjustment along the length of the boot, either symmetrically in opposite directions, in a manner that permits modification of the distance between the binding elements, or in the same direction, in a manner to modify the position of the ski binding.

SUMMARY OF THE INVENTION

The present invention has as a goal the provision of a ski binding equipped with a displacement device for the binding elements permitting, by a very simple selection means, either the symmetric displacement of the binding elements in opposite directions in a manner which modified the distance between the binding elements, or in the same direction, in a manner to modify the position of the ski binding without modifying their separation.

In order to attain this goal, the binding device according to the invention is characterized in that the gear coupling device comprises a first principal gear engaged with the teeth of one of the said arms, a second principal gear of the same diameter and of the same module as the first gear, engaging with the teeth of the other arm, and at least two auxiliary gears, one of the four gears being able to occupy a first and second position, of the type that when the gear occupies the first position, the first principal gear and the second principal gear directly engage one with the other or by an intermediary of at least one auxiliary gear such that they turn in opposite directions and, when the gear occupies the second position, the first and the second principal gears are coupled by an intermediary of at least one auxiliary gear, such that they turn in the same direction.

According to a preferred embodiment of the invention, the device comprises a first auxiliary gear of the same diameter and of the same module as the first principal gear, coaxially, rotatably connected to the first gear and permanently engaged with the second auxiliary gear, the first principal gear occupying the first level and the first auxiliary gear occupying a second level separated from the first level by an intermediate level, the thickness of the second auxiliary gear being such that the auxiliary gear occupies the second level and the intermediate level, and in that the second principal gear is vertically displaceable along its axis and positionable in a manner to occupy either the first level in which it comes into engagement with the first principal gear, or the intermediate level in which it comes into engagement with a second auxiliary gear, such that the displacement of one of the supports has the effect of simultaneously driving the two supports in the same direction when the second principal gear occupies the first level and the effect of simultaneously driving the two supports in opposite directions when the second principal gear occupies the intermediate level.

By adding a second auxiliary gear, it is possible to bypass the intermediate level. According to an embodiment, the device comprises two identical auxiliary gears engaged one with the other of which one is permanently engaged with the first principal gear, the first principal gear occupying the two levels, a third auxiliary gear occupying a first level and the other auxiliary gears the second level, the second principal gear being displaceable along its axis such that it can occupy the first or the second level, the second principal gear driven with the third auxiliary gear when it occupies the first level and with the other auxiliary gear when it occupies the second level.

It is also possible to work in a single level. According to an embodiment, the first auxiliary gear is in permanent engagement with the second principal gear, a second auxiliary gear is mounted between the first and the second principal gear and it is displaceable in the plane of the other gears between a first and a second position, the second auxiliary gear engaging with the second principal gear in the first position and with the first auxiliary gear in the second position.

BRIEF DESCRIPTION OF THE DRAWINGS

The attached drawings represent, by way of an example, the preferred embodiment of the invention.

FIG. 1 is a partial schematic, plan view of an adjustment mechanism for a ski binding.

FIG. 2 is a cut-away view according to line II—II which passes the axes of all the gears and in which the second gear occupies a first level.

FIG. 3 is a analogous cut-away view of the one represented by FIG. 2, but in which the second gear occupies an intermediate level.

FIG. 4 is a cut-away view according to IV—IV of FIG. 1.

DESCRIPTION OF THE PREFERRED EMBODIMENTS

Figures 8, 9, 10:
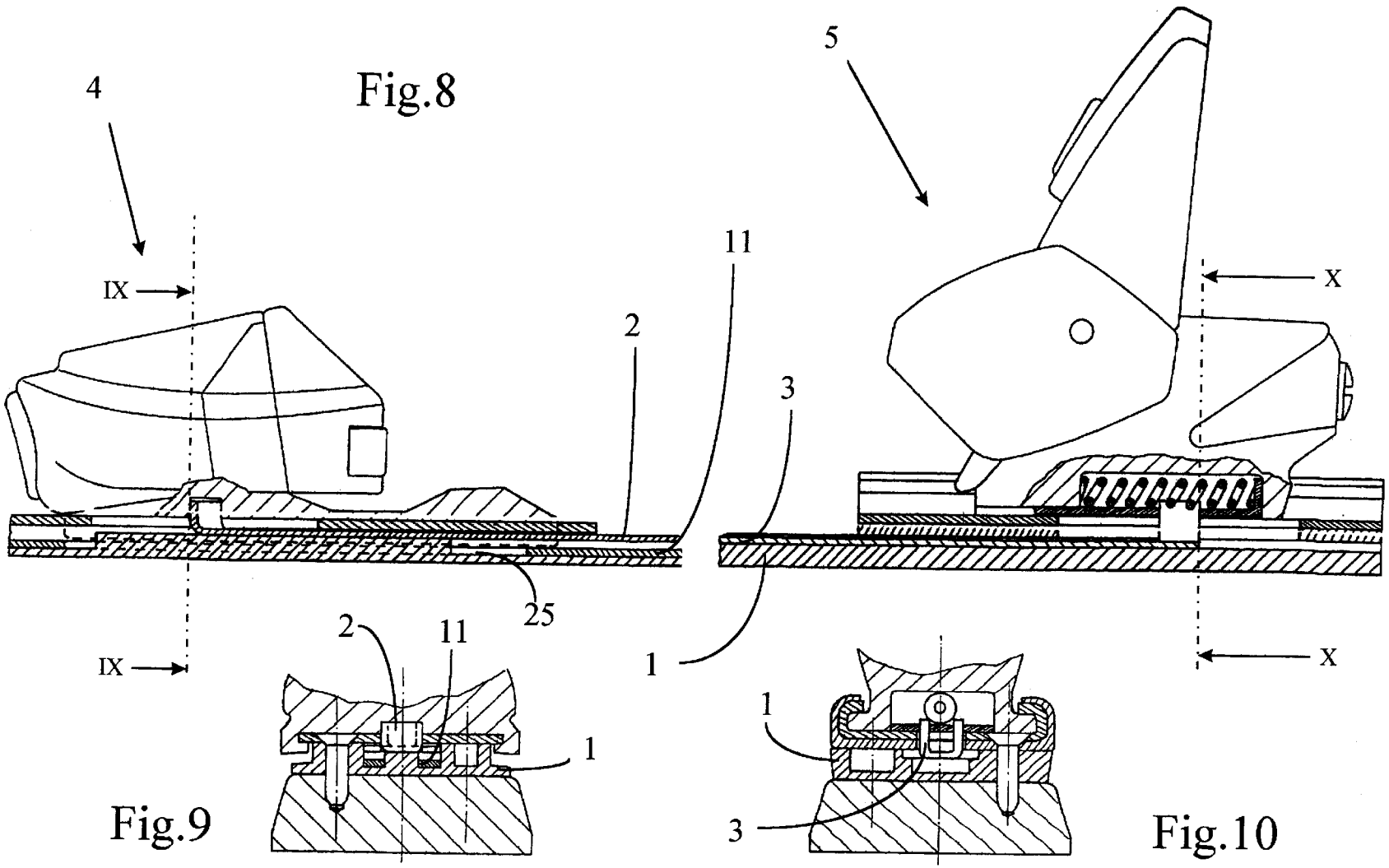
FIG. 8 is an elevation view and an axial cut-away view of the extremities of the ski binding showing the binding elements in the front and the rear.
FIG. 9 is a cut-away view according to line IX—IX of the FIG. 8.
FIG. 10 is a cut-away view according to X—X of FIG. 8.

The binding comprises essentially a slide 1, two binding elements 4 and 5 (FIG. 8) respectively slidably mounted in the front and the rear in the slide 1, a connecting bar 2 connected to the front binding element 4 and a connecting bar 3 connected to the rear binding element 5, a first principal gear 6, a second principal gear 7, a first auxiliary gear 8, a second auxiliary gear 9, a lever 10 for changing the direction of rotation of the second principal gear 7 and a locking component 11.

The axis of the gears are perpendicular to the plane of the slide 1 and the four gears have the same diameter and the same module. The second auxiliary gear 9 is mounted coaxially to the principal gear 6, rotationally supported with the principal gear and a certain distance above the principal gear 6, the teeth of the principal gear 6 and of the auxiliary gear 9 being perfectly aligned, of the type that the first principal gear and the second auxiliary gear are the equivalent of a single gear of which the teeth would have been eliminated along a certain length. The first principal gear 6, the second auxiliary gear 9 and the space between the two gears define respectively a first or lower level, a second level or high level and an intermediate level. The first principal gear 6 and the auxiliary gear 9 are fixed on a hub 12 fixed on an axle 13 simultaneously serving the connecting piece between the slide 1 and a cover plate 14. The hub 12 presents two flats which rotationally bind the gears 6 and 9. In plate 14, two pivots 15 and 16 are formed on which are respectively mounted, free to rotate, the second principal gear 7 and the auxiliary gear 8. The second principal gear 7 is able among other things to slide axially on its pivot 15 in a manner to be able to occupy either the lower level, as represented in FIG. 2, or the intermediate level as represented by FIG. 3.

The connecting bar 2 comprises, in the area of the gears, an arm 17 extending parallel to the axis of the slide 1 and pushing itself against the side of the slide. In the same way, the other connecting bar 3 presents, in the area of the gears, an arm 18 extending parallel to the arm 17 along the opposite side of the slide. With regard to the gears, the arms 17 include teeth 19 in the form of a rack engaged with the second principal gear 7 at either of the two levels of the principal gear 7. Also, the arm 18 comprises teeth 20 in the form of a rack engaging with the first principal gear 6. The auxiliary gear 8 extends above the arm 18 of which the height is therefore inferior to that of the arm 17, so that it is not cumbersome, considering that the first principal gear 6 does not work except in the lower level.

More precisely, the first principal gear 6 is not fixed directly on the hub 12, but on the hubof a toothed auxiliary wheel 21, itself fixed on the hub 12, under the principal gear 6. This toothed wheel 21 comprises, with component 11, the locking means or the locking of the adjusting device in the chosen position.

The maneuvering lever 10 having the purpose of modifying the position of the gear 7 is shown in the form of a lever rotationally mounted by means of an axle 22 and providing at its extremity a cam 23 in the form of a rectangular palette capable of occupying a first horizontal position under the second principal gear 7 in which the principal gear 7 occupies the lower level (FIG. 2) and a second vertical position (FIG. 3), in which the second principal gear 7 is maintained at an intermediate level.

Figure 5:
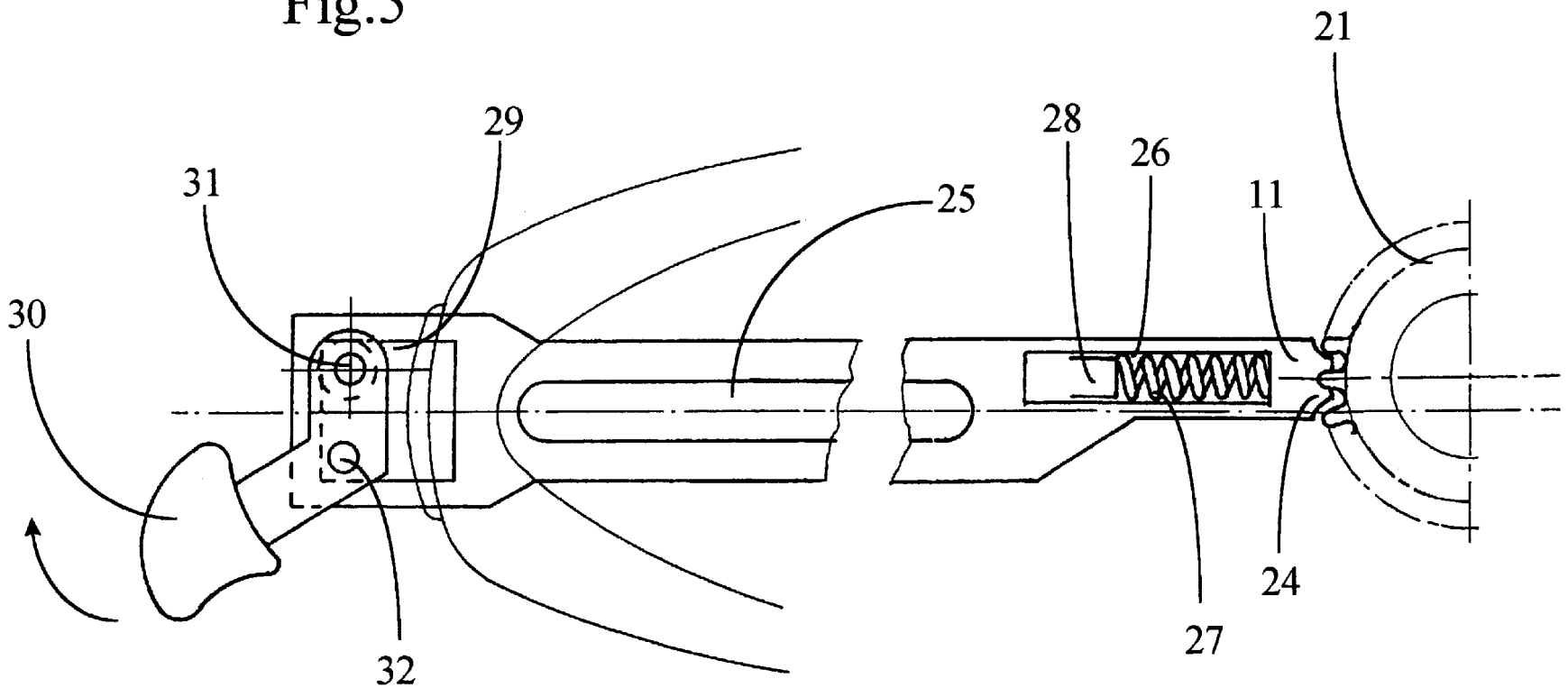
FIG. 5 is a plan view of the locking device of the means of adjusting the locked position.
Figure 6:
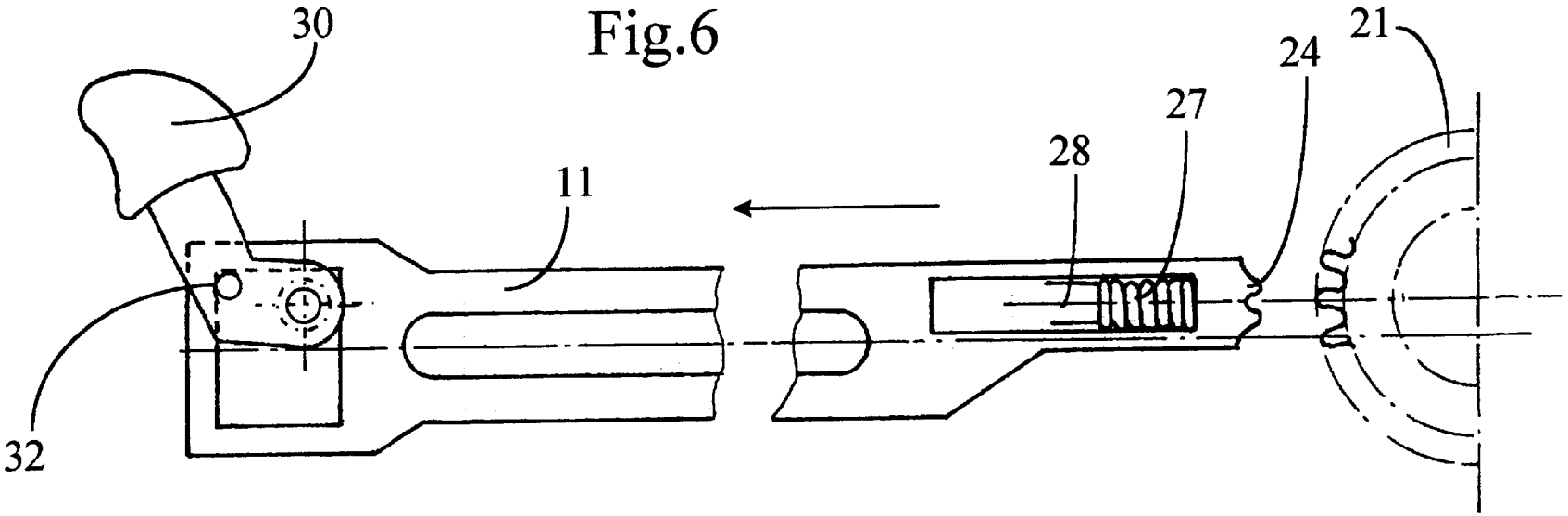
FIG. 6 represents the same device in a locked position.

In FIG. 4, one sees that the toothed wheel 21 occupies the bottom of the slide below the level occupied by the arms 17 and 18, that is to say, below the sliding plates 2 and 3. The locking element 11, situated at the same level, comprises a slidably bar axially mounted in the slide 1 by a guide port or slot 25 and provided, at an extremity, with two teeth 24 coming into engagement with the teeth of the toothed wheel 21 for preventing rotation. The bar 11 presents, among other things, a longitudinal cutout 26 in which a compression spring 27 is mounted between the extremities of the cutout 26 and a fixed bearing surface 28 for pushing the bar 11 against the toothed wheel 21. At its other extremity, the bar 11 comprises a square cutout 29 for longitudinally driving by means of the rotationally mounted lever 30 rotatably mounted on the slide 1 about an axle 31 and providing a crankpin 32 engaged in the cutout 29, of the type that the rotational driving of the lever 30 in the direction of the arrow in FIG. 5 has the effect of driving the bar 11 by the crankpin 32, in the direction of the arrow in FIG. 6 and as a consequence disengaging the bar 11 from the toothed wheel 21, as represented in FIG. 6.

Figure 7:
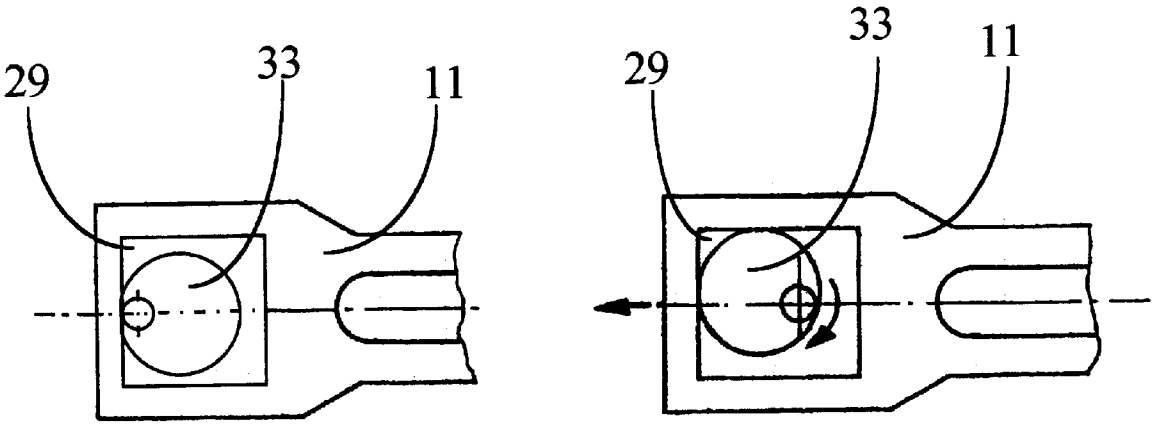
FIG. 7 represents an alternate embodiment, in two positions, of a means of maneuvering the locking device.

In place of the lever, one could use a simple eccentric 33, such as that represented by FIG. 7.

The functioning of the device shall now be described with reference essentially to FIGS. 1 to 3.

The slide 1 being fixed on the ski, we assume first of all that one wishes to displace the binding assembly of the ski relatively about the middle point of the ski, without modifying the distance between the binding elements 4 and 5.

One places the lever 10 in a horizontal position and the lever 30 in the position shown in FIG. 6. In this position, the principal gear 7 is at its lower level and the toothed wheel 21 is freed.

If one displaces, for example the heel piece 5 on the slide, the connecting bar 3 drives the principal gear 6 that circumferentially drives the principal gear 7. The gears 6 and 7 turn consequently in an opposite sense and drive the connecting bars 3 and 2 in the same direction, with the same displacement. Once in the chosen position, one returns the lever 30 to the position represented in FIG. 5, such that the effect is the locking of the adjustment device.

If, on the contrary, one desires to modify the distance between the binding elements 4 and 5, for example for adapting the binding to a size of a particular boot, one begins by freeing the adjustment device by means of the lever 30, then one places the lever 10 in a vertical position, which has the effect the raising of the principal gear 7 to the intermediate level (shown in FIG. 3) in which it comes into engagement with the auxiliary gear 8. The displacement of the heel piece 5 then has the effect of driving the principal gear 7 by the intermediary of the intermediate gears 8 and 9, that is to say, in the same direction of gear 6. The connecting bar 2 and 3 are, as a consequence, driven in the opposite direction, relatively symmetrically about the axis 13. The adjustment device is then locked as before.

In parting from the represented embodiment, it would be possible to reduce the height of the mechanism by adding a third auxiliary gear, which would permit the elimination of the intermediate level. The auxiliary gear 8 would occupy the lower level and mesh with the principal gear 6, being thicker such that it occupies both the high and low levels. The high level would be occupied by two mutually engaged auxiliary gears, one of the auxiliary gears meshing with the gear 6. The gear 7 would engage with the auxiliary gear 8 at its lower level and with the other auxiliary gear at its higher level.

It would be equally possible to work in a single level, for example using an auxiliary gear capable of occupying two positions in a plane, one first position in which it is engaged with the gears 6 and 7 and a second position in which it is engaged with the gear 6 with a second auxiliary gear permanently engaged with the gear 7.

The use of a auxiliary toothed wheel 21 for locking the adjustment device permits the creation of a significant locking interface thanks to the larger diameter of the wheel 21, but it would be of course possible to bypass the wheel 21 by locking one of the gears.

What is claimed is:

1. A binding device for attaching a ski boot to a ski comprising a front binding element (4) and a rear binding element (5) longitudinally displaceable on a slide (1) fixed to the ski and respectively interconnected with connecting bars (2, 3), these connecting bars being provided with arms (17, 18) which extend parallel to the longitudinal axis of the slide on each side of the axis, each arm facing each other and presenting a toothed rack (19, 20) facing the teeth of the opposed arms for their mutual driving by a gear coupling device mounted between the arms and on a perpendicular axis to the ski and rotatably lockable by manually actuatable locking and unlocking means (11), unlocking permitting the simultaneous longitudinal displacement of binding elements by the displacement of the one of the binding elements, characterized in that the gear coupling device comprises a first principal gear (6) engaged with the teeth (20) of the arms, a second principal gear (7) of the same diameter and the same module as the first gear, engaged with the teeth (19) of the other arm, and at least two auxiliary gears (8, 9), one (7) of the four gears able to occupy a first and a second position, which when the gear occupies the first position, the first principal gear (6) and the second principal gear (7) engage directly one with the other or by an intermediary of at least one auxiliary gear such that they turn in opposite directions and, when the gear occupies the second position, the first principal gear (6) and the second principal gear (7) are coupled by an intermediary of at least one auxiliary gear (8,9) such that they turn in the same direction.

2.The device according to claim 1, further comprising the first auxiliary gear (9) of the same diameter and of the same module as the first principal gear (6), coaxially rotatably supported with the first principal gear and permanently engaged with the second auxiliary gear (8), the first principal gear (6) occupying a first level and the first auxiliary gear (9) occupying a second level separated from the first level by an intermediate level, the thickness of the second auxiliary gear (8) being such that the auxiliary gear occupies the second level and the intermediate level, and in that the second principal gear (7) is vertically displaceable along its axis and positionable in a manner to occupy either the first level, in which it comes into engagement with the first principal gear (6), or the intermediate level in which it comes into engagement with the second auxiliary gear (8), such that the displacement of one of the binding elements (4, 5) has the effect of simultaneously driving the two binding elements in the same direction when the second principal gear occupies the first level and has the effect of simultaneously driving the two binding elements in opposite directions when the second principal gear occupies the intermediate level.

3. The device according to claim 2, further comprising the locking means having a toothed wheel (21) coaxially rotatably supported by a first principal gear (6) and a sliding component (11) coming into engagement with the teeth of the toothed wheel when in a locking position.

4. The device according to claim 1, further comprising identical first and second auxiliary gears in engagement one with the other and of which one is in permanent engagement with the first principal gear, a third auxiliary gear occupying a first level, the first and the second auxiliary gears occupying a second level, the first principal gear occupying the two levels and the second principal gear being displaceable along its axis in a manner to occupy the first or the second level, the second principal gear engaging with the third auxiliary gear while occupying the first level and engaged with the other auxiliary gear when occupying the second level.

5. The device according to claim 1, further comprising a first auxiliary gear permanently engaged with the second principal gear, a second auxiliary gear, mounted between the first and the second principal gears and displaceable in the plane of the other gears between a first and a second position, the second auxiliary gear engaging with the second principal gear in the first position and with the first auxiliary gear in the second position.

* * * * *